United States Patent [19]

Kucera et al.

[11] 4,054,041

[45] Oct. 18, 1977

[54] PATTERN WHEEL OPERATED SELECTING JACKS ARMS

[75] Inventors: Jaromir Kucera; Jindrich Novacek; Gustav Voda; Otokar Chladek; Jan Kollmann; Pavel Brada, all of Trebic, Czechoslovakia

[73] Assignee: Elitex, Koncern textilniho strojirenstvi, Liverec, Czechoslovakia

[21] Appl. No.: 672,841

[22] Filed: Apr. 2, 1976

[30] Foreign Application Priority Data

Apr. 3, 1975 Czechoslovakia ..... 2267/75

[51] Int. Cl.[2] ..... D04B 15/76

[52] U.S. Cl. ..... 66/50 A

[58] Field of Search ..... 60/50 R, 50 A, 50 B, 60/38, 40, 42, 57

[56] References Cited

U.S. PATENT DOCUMENTS

| | | | |
|---|---|---|---|
| 2,962,881 | 12/1960 | Williams | 66/50 B |
| 3,726,111 | 4/1973 | Negri | 66/50 R |
| 3,791,174 | 2/1974 | Guell | 66/50 R |
| 3,922,886 | 12/1975 | Moyer | 66/50 R |

*Primary Examiner*—Mervin Stein
*Assistant Examiner*—Andrew M. Falik

[57] ABSTRACT

A needle selecting system having a pair of rockable selector jacks mounted in tandem in each needle groove below the needle retained therein. The adjacent ends of the jacks are formed with butts engageable selectively by projecting elements of a pattern wheel mounted adjacent the needle cylinder, which causes the selector jacks to engage in appropriate paths in the cam system, thus displacing the needle. The cam system is arranged with surfaces which push back the selector jacks into their original position, which surfaces are formed in front of the clearing point for each yarn feed.

3 Claims, 4 Drawing Figures

PATTERN WHEEL OPERATED SELECTING JACKS ARMS

BACKGROUND OF THE INVENTION

The present invention relates to a system and apparatus for selecting needles for patterning, in a multifeed circular knitting machine.

Multifeed circular knitting machines are provided with a needle cylinder having a plurality of vertical parallel grooves in each of which is slidably located a needle which is adapted to move, according to a predetermined pattern, in cooperation with other needles or sinkers to form loops of yarn fed to them, from feeds spaced about the cylinder. The selection of the appropriate needle and the control of its movement is conventionally provided by locating one or more selectors and/or jacks within the groove which may be controlled to swing into and out of engagement with a cam system to effect transfer of the needle into operating position and which in cooperation with the cam system cause the needle to vertically reciprocate into either the closing or tucking position or not move at all. The primary movement of the needles is generally initiated by selection of an upper selector jack in abutment with the needle while the auxiliary selection is initiated by a lower selector jack. Patterning means are provided which are actuable in accord with the patterning system to independently control (i.e. select) the appropriate selector jacks and/or the sinker selecting system. The selectors are generally rockable within the groove, as well as slidable so that the patterning means is capable of swinging the selectors into and out of its respective cam system whereby vertical reciprocation is obtained. The selector jacks are normally pressed or swung back into their original positions (i.e. inoperative) after or behind the yarn feed in which they lifted the needles into knitting position.

Although this system is reliable in its operation, it requires considerable space about the circumference of the needle cylinder for each feed system. Thus if its is necessary, in each feed system to perform a new needle selection then it is impossible with the foregoing system to employ a plurality of feeds, particularly if the machine lies intermediate a large and small diameter.

An object of the present invention is to provide a selection system which overcomes and/or mitigates the aforementioned disadvantages and which provides a simple and reliable system for plural needle selection in multifeed circular knitting machines.

The foregoing objects as well as others together with the numerous advantages of the present invention will be found in and are set forth in the following disclosure.

SUMMARY OF THE INVENTION

According to the present invention a multifeed knitting machine is provided having a needle cylinder in which a plurality of needles are mounted in respective grooves and are each displaceable into knitting positions in cooperation with a sinker or opposed needle by a cooperating cam system, and a needle selecting system. The needle selecting system comprises a pair of rockable selector jacks mounted in tandem in each needle groove below the needle retained therein, the adjacent ends of which are formed with butts engageable selectively by projecting elements of a pattern wheel mounted adjacent the needle cylinder, which cause the selector jacks to engage appropriate paths in the cam system thus displacing the needle. The cam system is arranged with surfaces which push back the selector jacks into their original position, which surfaces are formed in front of the clearing point for each yarn feed.

Full details of the present invention are set forth in the following disclosure and are illustrated in accompanying drawings.

DESCRIPTION OF THE INVENTION

Figure 1:
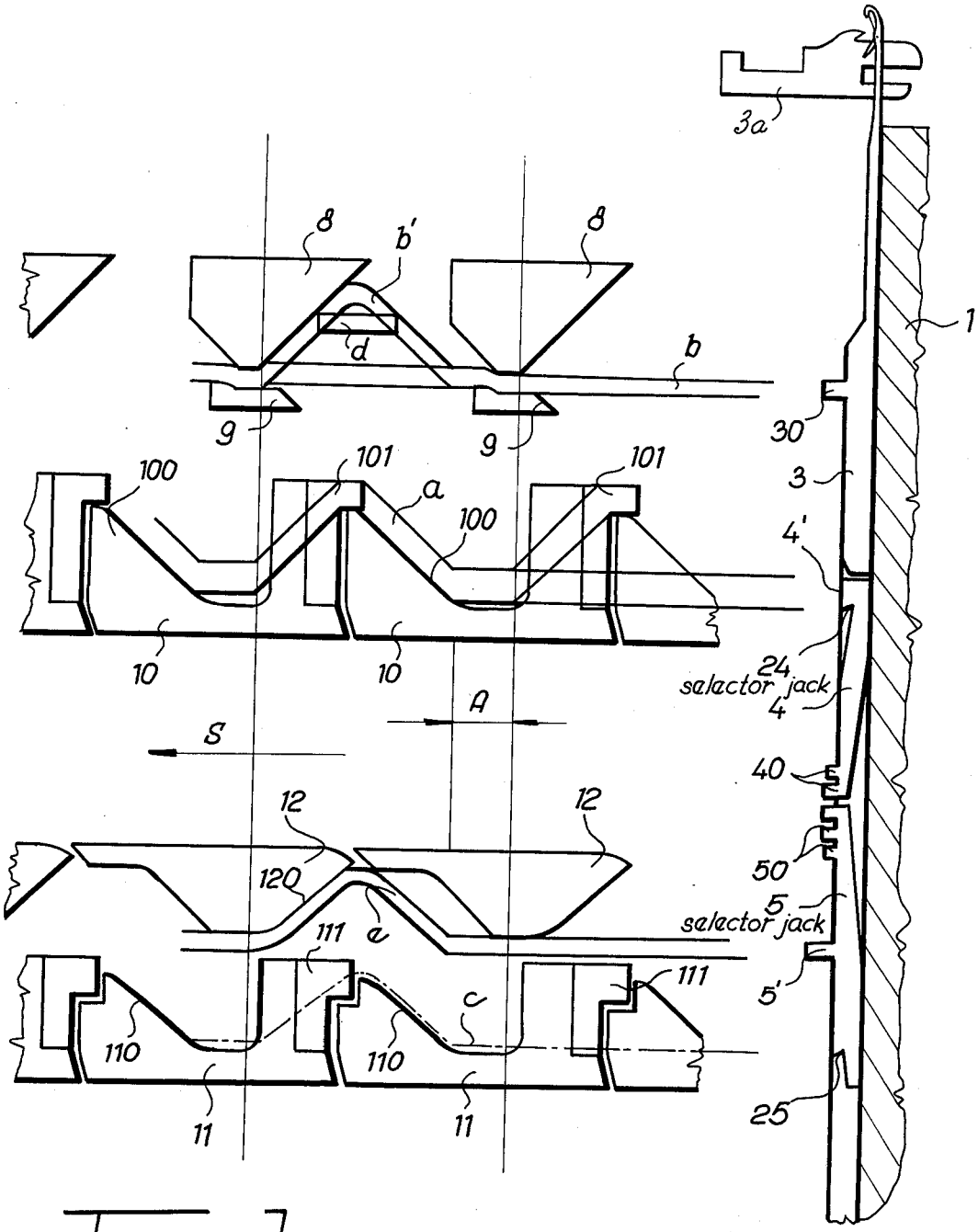
FIG. 1 is a partial sectional view of the needle cylinder of a multifeed knitting machine and a planar development of the associated cam system.
Figure 1A:
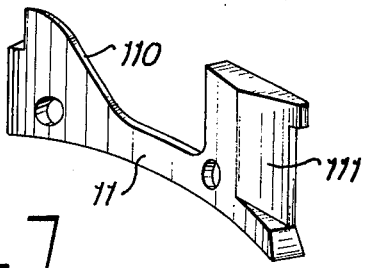
FIG. 1*a* is an isometric view of the retracting cam employed in the system of FIG. 1.

In the drawing a multifeed circular knitting machine is depicted showing only those conventional portions necessary for an understanding of the present invention. Portions of conventional structure and function are not shown.

As seen in the figures, a needle cylinder 1, rotatable about its central axis in the direction indicated by the arrow S is provided with a plurality of longitudinally extending parallel grooves 2 in each of which a needle 3 is mounted so as to be reciprocably movable therein. Each needle is provided with a control butt 30. Mounted in each groove below the needle is a first rockable selecting jack 4 below which is mounted a second rockable selecting jack 5. The selecting jacks 4 and 5 are also reciprocably movable in the groove, and have an inner edge which is in at least two portions, set at angles to each other to define a pivot point about which the respective jack rocks.

The needles 3 cooperate to form loops with known, not shown, sinker elements 3*a*, arranged at the upper end of the needle cylinder. The yarn is laid in feeds by means of conventional yarn guides, of which the machine is provided with several. Surrounding the exterior of the needle cylinder is a control cam system provided with cam means by which the sinkers, needles and jacks are caused to reciprocate in the prescribed knitting pattern. At each of the yarn feeds the cam system is provided with a sinker cam 8 and a needle trough 9 which defines a cam path *b* in which the needle butt 30 rides when not selected and a path *b'* in which the needle moves, when it, ie: the needle, is selected. The clearing point or terminus of cam 8 is illustrated by the vertical lines.

The vertical movement of the selector jacks, controlling the selection of the needle is also effected by the cam system. Selector jack 4 provided with a control butt 4', which when the jack is selected is caused to engage on the upper edge of rising cams 10, each having an upwardly inclined edge 100, which is arranged in such a manner to have a path *a* which causes the jacks 4 to move upwardly in the space of each feed, between the clearing points with each of its adjacent feeds. At the end of each upwardly inclined edge 100 of each cam 10 is a laterally extending inclined retracting edge 101 which causes the jack 4 to be pushed back allowing it to descend into the next succeeding cam 10. The lower selector jacks 5 are moved in a path *c*, in the same manner, by engagement of its control butt 5' in a set of cams 11, each cam 11 having a rising edge 110 and an inclined surface 111, which extends laterally outward from the plane of the cam system. In order to retract the lifted selectors 5, sinker cams 12 having clearing edges 120 are arranged cooperatively above the cam 11. The cam 11 and 12 are distributed with respect to the feed systems in a similar manner and position as are cams 10.

The engagement of the selectors 4 and 5 with their respective cams is effected by a pattern selection system in which a rotating patterning wheel 6 (FIG. 2) is arranged adjacent the exterior of the needle in the section A of the cam system (FIG. 1) immediately after the clearing point of each of cams 8. The wheel 6 is mounted to rotate at a speed identical with that of the needle cylinder and is provided with one or more extending elements which selectively engage the butt formation 40 or 50 formed respectively on the adjacent ends of the selecting jacks 4 and 5. The selecting elements may be either cams, pins or comb. The patterning wheel 6 may be replaced with a drum, disk stack or similar selecting means such as a solenoid or press button system, which may be automatically controlled, as is known.

Figure 3:
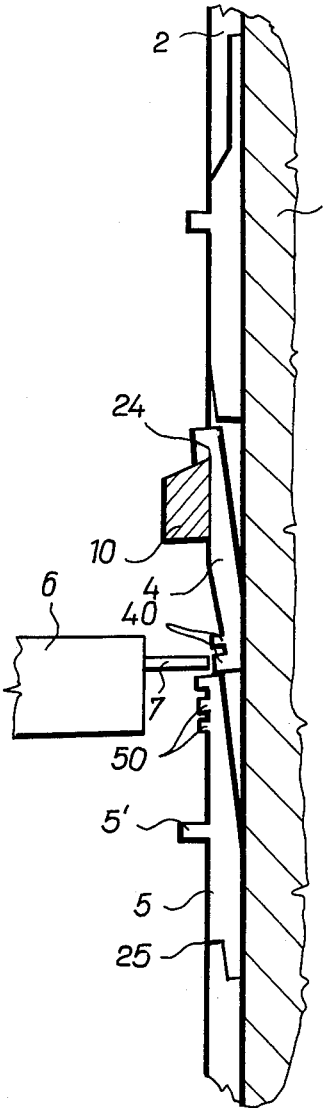
FIG. 3 is a view similar to FIG. 2 in position to select the upper selector jack.

In operation, the selection of selectors 4 and 5 is carried out by the patterning wheel 6 located in the section A immediately behind the clearing point of cam 8 of the preceeding feed. If the selecting means 7 on the patterning wheel 6, is in the position as shown in FIG. 3, the lower butts 40 of selector jack 4 is pushed back into groove 2 of needle cylinder 1 forcing butt 4' into path *a* so that the recess 24 contacts rising cam 10. The selector jack 4 is thus lifted by lifting edge 100, as represented by path *a*. Simultaneously, selector jack 4 lifts needle 3 as far as its clearing position, as represented by path *b'* of butt 30, in which yarn is laid into needle 3, a plain loop being formed by clearing on cam 8. The selector jack 4, or its upper butt 4' respectively following in its uppermost position the path *a*, contacts the inclined surface 101 and is pushed back to its original position as shown in FIG. 1. Upon further rotation of needle cylinder 1, the selector jack 4 is cleared back into its lower position by needle 3 which engages the cam 8 and forces downwardly on the selector jack 4 preparing it for another feed. During the procedure as specified above, the lower selector 5 passes through the lower position as shown in FIG. 1, in inactive status.

Figure 2:
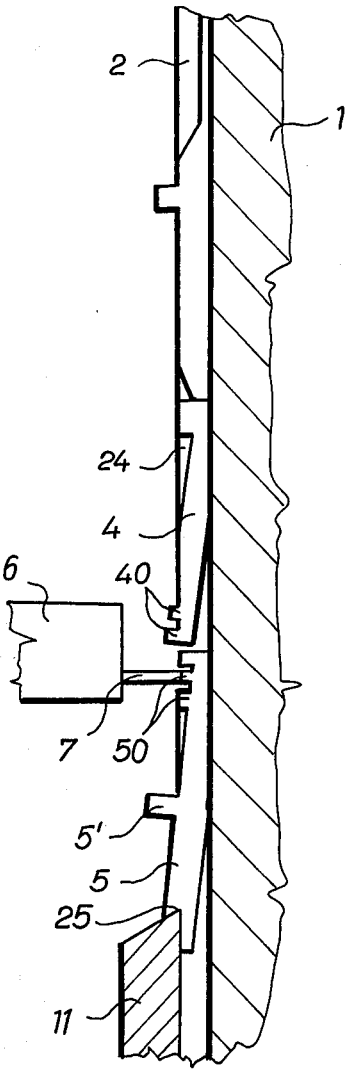
FIG. 2 is a partial sectional view of the needle cylinder of FIG. 1 illustrating the position of the patterning wheel in position to select the lower selector jack.

When the selection element 7 on the patterning wheel 6 is in the position as shown in FIG. 2, the upper butt 50 of selector 5 is pushed into groove 2 of needle cylinder 1 and the recess 25 formed at the lower end of the selector jack 5 contacts the rising cam 11. Selector jack 5 is thus lifted by rising edge 110, as represented by path *c*. The selector 5 is in contact with selector 4 and lifts the latter, which in turn lifts needle 3 as far as its tucking position, in which butt 30 of needle 3 follows path *d* and yarn is laid into the needle, a tuck loop being formed by clearing on cam 8. During laying yarn into the needle, the lower end of selector jack 5 contacts the inclined surface 111 and is pressed into its original position, and upon further rotation, selector jack 5 is drawn by its butt 5' along path *a* by sinker edge 120 of cam 12. Upon the following clearing of the needle by cam 8, selector 4 is cleared by needle 3 into its original position.

When no selection takes place, needles 3 and selector jacks 4 and 5 pass through their lower positions and no loops are formed.

By the procedure as specified above, needles 3 are selected into two operative positions in all feeds with a single arranged patterning wheel 6. The advantage of the present invention consists in that, selection into operative positions as well as clearing of displaceable elements in the grooves of a needle cylinder in a narrow angular section thereof is performed by simple means, thus making possible to distribute about the circumference a plurality of feeds.

As will be seen from the foregoing, a simple, reliable system is provided which enables the transfer of the needles into more than one position for each yarn feed, and which provides that retraction of the needle and the selector jacks before clearing of the needle. The system and the apparatus therefore is small and free of complex mechanisms so that it may be incorporated in most circular knitting machines without extensive modification or rebuilding of the machines.

Various modifications and changes have been suggested in the foregoing description. Others will be obvious to those skilled in this art. Consequently, it is intended that the present disclosure be illustrative only and not limiting of the scope of the invention.

What is claimed:

1. A knitting machine having multiple yarn feeds, a needle cylinder in which a plurality of needles are mounted in respective grooves, each displaceable into knitting positions in cooperation with a sinker or opposed needle by a cooperating cam system, and a needle selecting system, said needle selecting system comprising a pair of rockable selector jacks mounted in tandem in each needle groove below the needle retained therein, control butts formed on the adjacent ends of each of said selector jacks of said pair, a patterning wheel mounted adjacent the needle cylinder having projecting elements engageable selectively with said butts which cause the selector jacks to engage in appropriate paths of the cam system and be moved to displace the needle, said cam system having retracting surfaces which push back the selected selector jacks into their original position formed in front of the clearing point for each yarn feed.

2. The system according to claim 1, wherein the retracting surfaces are arranged on the descending path of the cam system controlling the respective selectors.

3. The system according to claim 1, wherein the cam system includes a sinker cam adapted to cause said lower selector to descend within said groove, said sinker cam having an edge ending ahead of the end of the cam for clearing the needle.

* * * * *